US005078545A

United States Patent [19]

Akesaka

[11] Patent Number: 5,078,545

[45] Date of Patent: Jan. 7, 1992

[54] METHOD FOR BORING HOLE IN THE GROUND AND APPARATUS THEREFOR

[75] Inventor: Toshio Akesaka, Yokohama, Japan

[73] Assignee: Kabushiki Kaisha Iseki Kaihatsu Koki of 31-6, Yoyogi 4-chome, Shibuya-ku, Tokyo, Japan

[21] Appl. No.: 561,883

[22] Filed: Aug. 2, 1990

Related U.S. Application Data

[63] Continuation of Ser. No. 367,541, Jun. 16, 1989, abandoned.

[30] Foreign Application Priority Data

Jun. 22, 1988 [JP] Japan ..... 63-152377

[51] Int. Cl.[5] ..... E02F 5/10

[52] U.S. Cl. ..... 405/142; 405/133; 37/189; 299/56

[58] Field of Search ..... 37/65, 189, 193; 175/102, 107, 350; 405/132, 133, 138, 139, 141-143, 146, 156, 184; 299/55-56, 64, 67

[56] References Cited

U.S. PATENT DOCUMENTS

| | | | |
|---|---|---|---|
| 1,657,609 | 1/1928 | Crickmer | 175/350 |
| 2,119,962 | 6/1938 | Raleigh | 37/189 |
| 3,077,936 | 2/1963 | Arutunoff | 175/350 |
| 3,861,477 | 1/1975 | Lazayres | 175/350 X |
| 4,296,970 | 10/1981 | Hodges | 37/65 X |
| 4,552,232 | 11/1985 | Frear | 175/350 X |
| 4,571,122 | 2/1986 | Yamamoto et al. | 405/184 |
| 4,624,605 | 11/1986 | Akesaka | 405/144 |
| 4,692,062 | 9/1987 | Akesaka | 405/141 |
| 4,736,987 | 4/1988 | Lenzen et al. | 175/350 X |
| 4,815,543 | 3/1989 | Lenzen et al. | 175/350 |

FOREIGN PATENT DOCUMENTS

| | | |
|---|---|---|
| 59-192193 | 10/1984 | Japan . |
| 60-242295 | 12/1985 | Japan . |
| 61-102999 | 5/1986 | Japan . |

*Primary Examiner*—Dennis L. Taylor
*Assistant Examiner*—Franco S. DeLiguori
*Attorney, Agent, or Firm*—Stoel Rives Boley Jones & Grey

[57] ABSTRACT

A system for boring a hole in the ground including an excavating machine provided with a tubular body; an excavating mechanism supported by the body; a mechanism for shifting the excavated substances to the periphery of the body; and a driving mechanism for operating the excavating mechanism.

12 Claims, 7 Drawing Sheets

METHOD FOR BORING HOLE IN THE GROUND AND APPARATUS THEREFOR

This is a continuation of application Ser. No. 367/541, filed June 16, 1989, now abandoned.

BACKGROUND OF THE INVENTION

1. Field of the Invention

This invention relates to a method for boring a hole in the ground by the use of an excavating machine and an apparatus therefor and, more particularly, to a boring method and an apparatus therefor suitable for the use in construction of a tunnel, laying of a pipe, renewal of an existing pipeline, construction of a vertical shaft and formation of a longitudinal hole or the like.

2. Description of the Prior Art

As one of methods for boring a hole in the ground, Japanese Patent Public Disclosure (KOKAI) No. Sho 59-192193 has disclosed a press-in method using an excavating machine including a shield body and a conical rotor disposed in front of the shield body for eccentric motion about an axis of the shield body. According to this press-in method, by making a thrust act on the shield body while eccentrically moving the rotor, a hole is formed while the earth and sand in front of the shield body are thrust aside by the rotor.

As another one of methods for boring a hole in the ground, Japanese Patent Public Disclosures (KOKAI) No. Sho 60-242295 and No. Sho 61-102999 have disclosed an excavating method using an excavating machine including a shield body, excavating means disposed in front of the shield body so as to be rotatable about an axis of the shield body and means for discharging substances excavated by the excavating means to the rear of the shield body. According to this excavating method, the ground is excavated by making a thrust act on the shield body while rotating the excavating means and then a hole is formed by discharging the excavated substances onto the ground surface. The excavated substances discharged onto the ground surface are subjected to predetermined treatment and thereafter transported to a predetermined place to be dumped.

However, the former method, that is, the press-in method involves a problem in that a large thrust should be made to act on the shield body since a large reaction acts on the rotor when the shield body is propelled. On the contrary, the latter excavating method involves a problem in that it is high in cost since all of the excavated substances are discharged onto the ground surface.

SUMMARY OF THE INVENTION

It is an object of the present invention to provide a method for boring a hole in the ground, which is low in cost and does not require that a large thrust is made to act on a body, and an apparatus therefor.

A method according to the present invention comprises the steps of advancing an excavating machine including a tubular body and excavating means supported by the body while excavating the ground by the use of the excavating means, and shifting the excavated substances to the periphery of the body.

In the boring method of the present invention, the excavated substances are preferably shifted to the periphery of the body through the inside of the body. More preferably, the excavated substances are forcibly thrust out from the inside of the body to the outside thereof and force for compressing the substances thrust out around the body is made to repeatedly act on those substances. Further, when gravels or like solid bodies are present in the excavated substances received in the excavating machine, the solid bodies are preferably crushed in the excavating machine.

An apparatus for boring a hole in the ground according to the present invention comprises an excavating machine provided with a tubular body, excavating means supported by the body so as to excavate the ground, means for shifting the excavated substances to the periphery of the body and driving means for operating the excavating means.

In the boring apparatus of the present invention, at least one hole for shifting the excavated substances from the inside of the body to the periphery thereof is preferably formed in the body. In this case, the excavating means is disposed in front of the hole, preferably on the front portion of the body.

The shifting means preferably includes a thrusting-out mechanism shifted in the radial direction of the body so as to forcibly thrust excavated substances around the periphery of the body through the hole. Further, the thrusting-out mechanism preferably includes a rotor eccentrically moved about the axis of the body so as to make compressive force for compressing the substances thrust out around the body repeatedly act on those substances. Furthermore, it is preferable that the rotor and the body constitute a crusher.

The excavating machine is advanced while excavating the ground by the use of the excavating means and the excavated substances are thrust out around the periphery of the body. Pipes, linings and piles or like members are disposed in a hole formed by the excavating machine, and these members are stably maintained by the excavated substances, therearound.

According to the excavating machine of the present invention, it is possible to advance the excavating machine with a thrust which is smaller than that in the prior art press-in method and apparatus therefor. Further, since the excavated substances are shifted to the periphery of the body, it is less liable to cause subsidence of the ground.

When all of the excavated substances are removed to the periphery of the body, the present method and apparatus may dispense with any means for discharging the excavated substances and any operation of treating the discharged substances, so that it becomes low in cost. Further, when part of the excavated substances is removed to the periphery of the body while the rest is discharged onto the ground surface, since the quantity of excavated substances to be discharged onto the ground surface is less than that in the case where all of the excavated substances are discharged onto the ground surface, the operation of treating the discharged substances on the ground such as transhipment and transportation of the discharged substances is reduced by a quantity corresponding to a reduction of the discharged substances, so that it becomes lower in cost.

According to one aspect of the invention, it is possible to shift the excavated substances to the periphery of the body without hindering the excavation by the excavating means.

According to another aspect of the invention, it is possible to securely shift the excavated substances to the periphery of the body.

According to another aspect of the invention, the substances thrust out around the body are consolidated through repetitive compression, so that the expansive force of the substances thrust out around the body is reduced. Accordingly, there is no possibility of increasing the frictional resistance between the body and the substances thrust out around the body while a great quantity of excavated substances may be shifted to the periphery of the body.

According to another aspect of the invention, since the solid bodies contained in the excavated substances are crushed, the excavated substances may be thrust out more securely.

According to another aspect of the invention, the rotor acts as means for crushing the solid bodies contained in the excavated substances, means for forcibly thrusting out the excavated substances and means for applying the repetitive compressive force to the substances thrust out around the body.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
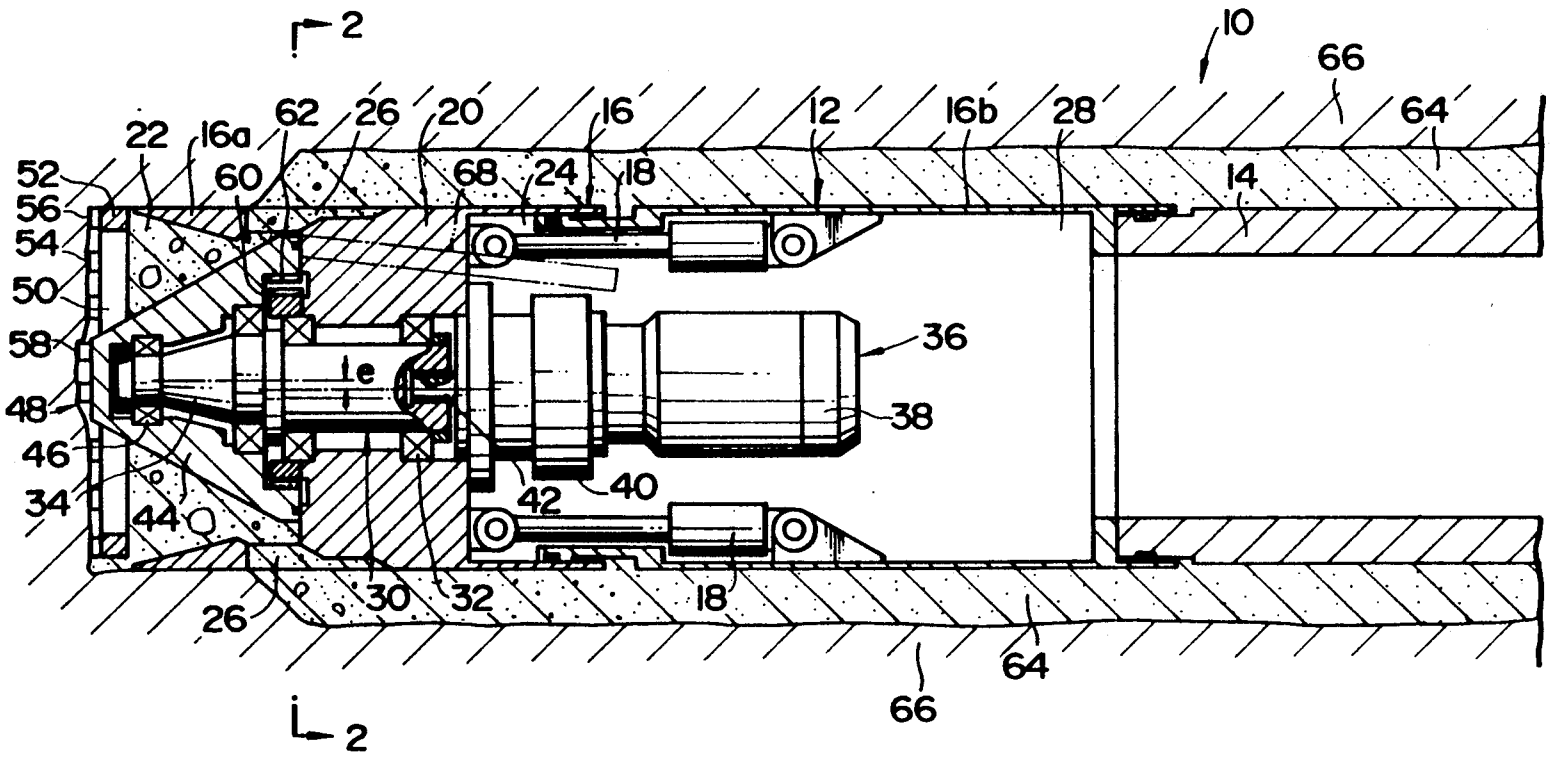
FIG. 1 is a longitudinal cross-sectional view showing an embodiment of a boring apparatus according to the present invention.

A boring apparatus 10 shown in FIG. 1 comprises a shield tunneling machine 12 and a basic thrust device (not shown) which is well known per se and exerting a thrust upon the tunnelling machine 12 and a plurality of pipes 14 connected to the rear of the machine. This boring apparatus is used for executing a pipe propelling method.

The shield tunnelling machine 12 includes a cylindrical shield body 16 divided into first and second bodies **16*a*, 16*b* which are coaxially butted against each other. The first and second bodies 16*a*, 16*b* are connected to each other by a plurality of jacks 18** providing directional correction.

The interior of the first body **16*a* is divided into two chambers 22, 24, which are spaced apart from each other in the direction extending along an axis of the shield body 16 through a partition wall 20 provided inside the first body 16*a*. The chamber 22 in front has a truncated conical shape with the bore gradually tapering toward the rear. The first body 16*a* has a plurality of window holes 26 for communicating between the chamber 22 and an outer peripheral portion of the shield body 16. Each of the window holes 26 is formed around the axis of the shield body 16** at uniform angular intervals.

The second body **16*b* connected to the rear portion of the first body 16*a* defines a chamber 28 communicating with the chamber 24 in the first body 16*a*. The front end portion of the second body 16*b* is slidably received in the rear end portion of first body 16*a*. A seal member is disposed between the inner surface of the rear end portion of the first body 16*a* and the outer peripheral surface of the front end portion of the second body 16*b***.

The partition wall 20 supports a crankshaft 30 such that the crankshaft 30 is rotatable about the axis of the shield body 16 through a plurality of bearings 32. The crankshaft 30 extends through the partition wall 20 along the axis of the shield body 16 so that an eccentric portion 34 of the crankshaft 30 is located on the side of the chamber 22. The crankshaft 30 is so arranged that a rotary axis of the crankshaft is coincident with a center axis of the shield body 16. The eccentric portion 34 is eccentric from the rotary axis of the crankshaft 30, that is, the axis of the shield body 16 by a distance indicated by e.

The crankshaft 30 is rotated by a drive mechanism 36 fixedly attached to the rear of the partition wall 20, that is, to the side of the chamber 24 by the use of a plurality of bolts. The drive mechanism 36 is provided with a motor 38 and a reduction gear 40. An output shaft 42 of the drive mechanism 36 is connected to the rear end portion of the crankshaft 30 so as to make relative rotation impossible, as shown in FIG. 1.

The eccentric portion 34 of the crankshaft 30 supports a rotor 44 such that the rotor 44 is rotatable about an axis of the eccentric portion 34 through a plurality of bearings 46. The rotor 44 is shaped to have a truncated conical outer surface with the diameter thereon gradually increasing from the front end toward the rear end. A seal material for maintaining the liquid tightness between the rear end surface of the rotor 44 and the front end surface of the partition wall 20 is disposed on the rear end portion of the rotor 44.

Figure 3:
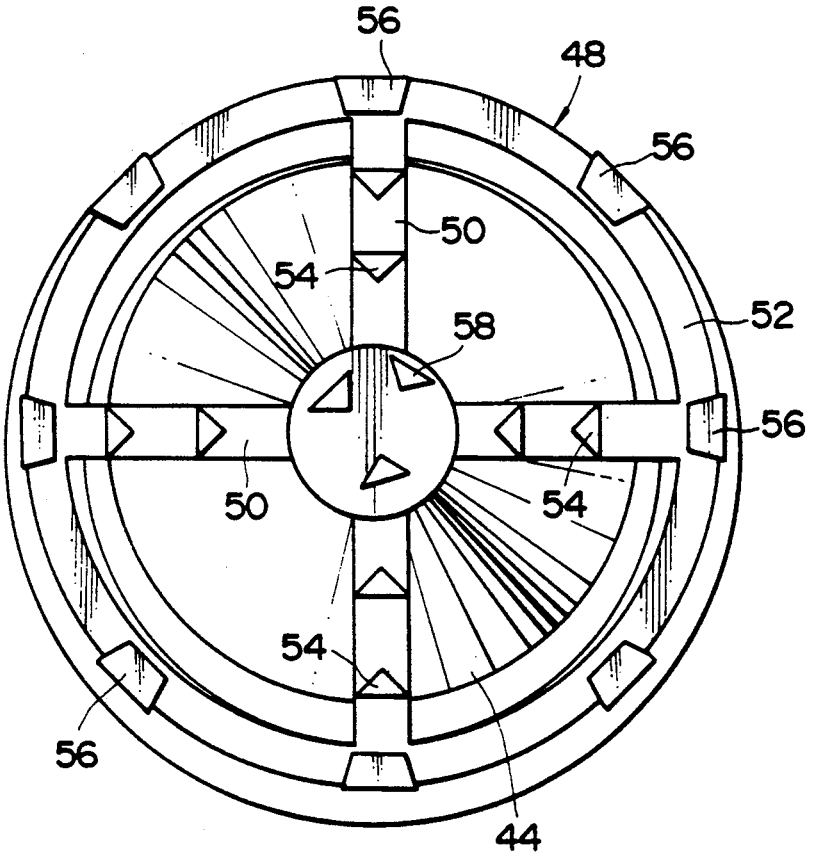
FIG. 3 is a front view of the cutter assembly of the boring apparatus.

A cutter assembly 48 is fixedly attached to the front end portion of the rotor 44. As shown in FIG. 3, the cutter assembly 48 is provided with a plurality of arms 50 extending from the rotor 44 in the radial direction of the shield body 16, a circular ring 52 for interconnecting the tip end portion of each of the arms 50, a plurality of cutter bits 54 and 56 fixedly attached to each of the arms 50 and the ring 52 respectively, and a plurality of cutter bits 58 fixedly attached to the front end surface of the rotor 44.

The cutter assembly 48 is disposed in front of the shield body 16 in the illustrated embodiment. However, in the case of a boring apparatus for boring a hole in the soft ground, the cutter assembly 48 may be disposed inside the shield body 16.

Figure 2:
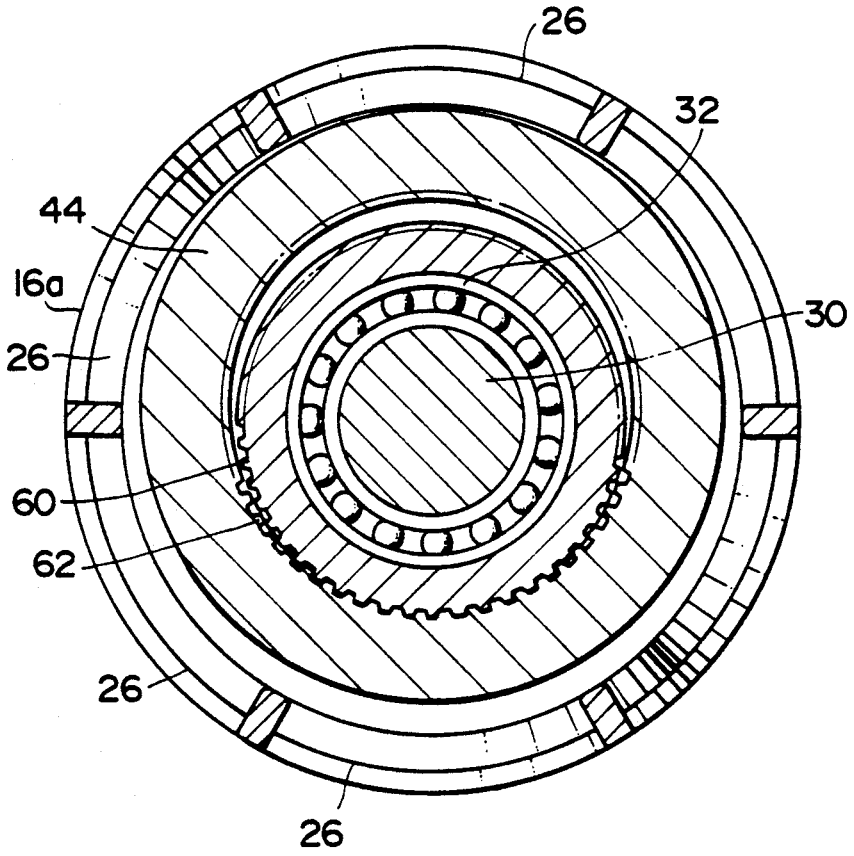
FIG. 2 is an enlarged-scale sectional view taken along a 2—2 in FIG. 1.

To the side of the chamber 22 of the partition wall 20 is fixedly attached an external gear 60 with the axis of the shield body 16 as a center. On the contrary, to the rear end surface of the rotor 44 is fixedly attached an internal gear 62 meshing with the external gear 60. The internal gear 62 is eccentric from the external gear 60 by the same distance as the eccentricity e of the eccentric portion 34 of the crankshaft 30. Accordingly, as shown in FIG. 2, the gears 60, 62 come into mesh with each other in one diametrical portion thereof. The portion where the gears 60,62 are meshed with each other is displaced about the axis of the shield body 16 with the rotation of the crankshaft 30. The external gear 60 may be fixedly attached to the rotor 44 while the internal gear 62 may be fixedly attached to the partition wall 20.

When the crankshaft 30 is rotated, both of the rotor 44 and the cutter assembly 48 are revolved around the axis of the shield body 16 and further rotated on their own axes around the axis of the eccentric portion 34 because the internal and external gears 62 and 60 are meshed with each other. The rotor 44 constitutes a crusher together with the first body 16*a*. Further, a plurality of projections extending in the circumferential direction of the first body 16*a* and rotor 44 may be respectively provided on the inner surface of the first body 16*a* and the outer surface of the rotor 44, which define the chamber 22.

During an excavation operation, the tunnelling machine 12 is advanced together with the pipes 14 by the thrust given from the basic thrust device through the pipes 14. When the machine 12 is advanced, the drive mechanism 36 is operated. In consequence, the crankshaft 30 is rotated about the axis of the shield body 16, so that both of the rotor 44 and the cutter assembly 48 are revolved about the axis of the shield body 16 while being rotated about the axis of the eccentric portion 34.

As a result, the surface of a working face is excavated by the cutter assembly 48 and the excavated substances are received in the chamber 22. Since the rotor 44 revolves around the axis of the shield body and rotates around its own axis, large solid bodies contained in the excavated substances received in the chamber 22 are crushed by the rotor 44 in cooperation with the first body 16*a*.

The excavated substances received in the chamber 22 are forcibly thrust out of the shield body 16 through each of the window holes 26 with the revolution of the rotor 44, that is, the turning thereof. The substances 64 thrust out of the shield body 16 are discharged between the existing earth and sand 66 and the shield body 16 by compressing existing earth and sand 66 around the shield body 16, as shown in FIG. 1.

The substances 64 and earth and sand 66 around the shield body 16 are repeatedly compressed with the revolution of the rotor 44. Therefore, the substances 64 and earth and sand 66 around the shield body 16 are gradually consolidated while expansive force of the substances 64 and that of the earth and sand 66 are gradually reduced.

The ground around the shield body 16 is repeatedly subjected to compressive force produced by the substances 64 thrust out of the periphery of the shield body 16. However, the compressive force acts as force for consolidating earth and sand while reducing the expansive force the earth and sand. As a result, a great quantity earth and sand may be discharged to the periphery the shield body 16. Further, there is no possibility of increasing the resistance between the shield body 16 and pipes 14 and the earth and sand the when the shield body 16 and pipes 14 are advanced Elevation of the ground surface may be prevented by setting between the shield body 16 and the surface to be more than a distance between the shield body 16 and the position where the compressive force with the earth pressure.

Further, the substance may be thrust out around the shield body 16 no by the rotor 44 but also by any other means. In case of a boring apparatus for the use in ground as soft ground, which is high in fluidity of the substances, means for guiding the excavated subs to each of the window holes may be provided of the rotor 44.

According to the s tunnelling machine 12, the force acting on the of the working face with the advance of the machine is not accumulated in the ground, so that it is less to cause the elevation of the ground.

Further, according shield tunnelling machine 12, since the excavated substances are thrust out of the periphery of the shield body 16 without removing any excavated substance, there is no possibility of occurrence of the ground subsidence, even if the earth and sand around each pipe 14 disposed in a spot produced after the excavation are brought into close contact with the pipe 14 due to the earth pressure with the lapse of time. Therefore, each of the pipes 14 may be stably maintained in position.

Furthermore, according to the shield tunnelling machine 12, since the excavated substances received in the chamber 22 are not shifted to the periphery of the shield body 16 unless the pressure in the chamber 22 increases to a certain degree, the pressure in the chamber 22 may be naturally rendered to maintain a predetermined value, so that the breaking of the face may be prevented without controlling the pressure in the chamber 22 with high accuracy.

Figure 4:
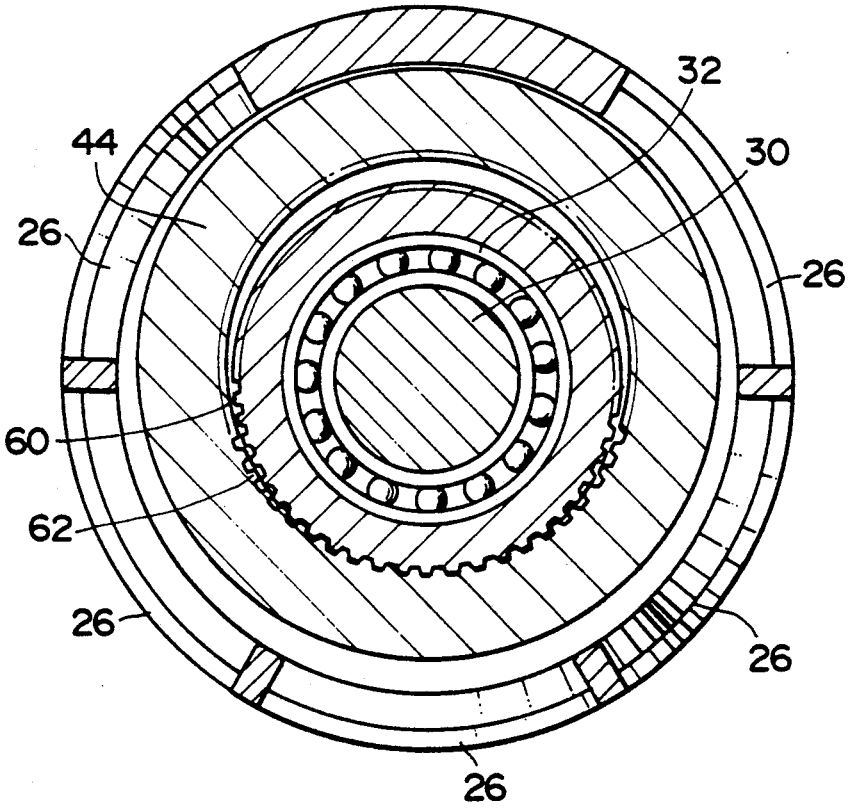
FIG. 4 is a sectional view similar to FIG. 2, showing a modification of the boring apparatus.

Further, since the excavated substances in the chamber 22 are thrust out through each of the window holes 26, by closing at least one window hole 26 to restrict the direction of discharging the excavated substances in the chamber 22, as shown in FIG. 4, it is possible to restrict the direction of the pressure acting on the ground around the shield body 16 due to the operation of forcibly thrusting out the excavated substances.

Further, part of the excavated substances may be discharged onto the ground surface. In this case, for example, use is made of a discharge mechanism 68 provided with a tubular casing and a screw conveyor rotatably received in the casing, as shown by a two-dotted line in FIG. 1, and the excavated substances in the chamber 22 may be discharged to the side of the chamber 24 by the use of the discharge mechanism 68.

Figure 5:
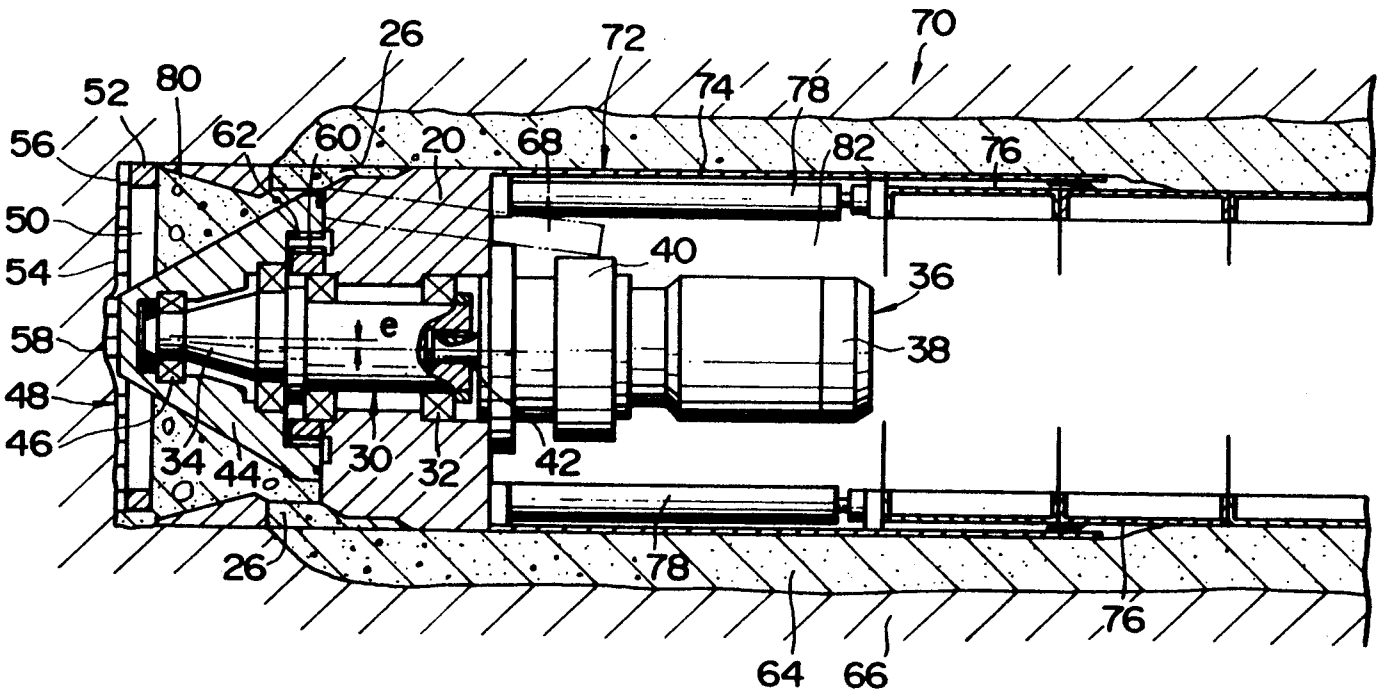
FIG. 5 is a longitudinal cross-sectional view showing another embodiment of the boring apparatus according to the present invention.

A boring apparatus 70 as shown in FIG. 5 comprises a self-travelling shield tunnelling machine 72 and is used for executing the excavation of a tunnel with a large bore. In the illustrated embodiment, the shield tunnelling machine 72 is different from the shield tunnelling machine 12 shown in FIGS. 1 through 3 in that a shield body 74 is not divided into two bodies, and this machine 72 does not include any jack for the use of directional correction but includes a plurality of propulsion jacks 78 for advancing the shield body 72 by making a reaction act on a segment ring 76 incorporated in a spot produced after the excavation by the machine 72.

However, the shield body 74 has a partition wall 20 for dividing the interior of the shield body 74 into two chambers 80, 82 spaced apart from each other in the axial direction of the shield body and a plurality of window holes 26 for communicating between the chamber 80 and the outside of the shield body 74. The chamber 80 has a truncated conical shape with the bore gradually tapering toward the rear.

The shield tunnelling machine 72 includes a crankshaft 30 supported by the partition wall 20 such that the crankshaft 30 is rotatable about an axis of the shield body 74, a drive mechanism 36 for rotating the crankshaft 30, a rotor 44 supported by an eccentric portion 34 so as to be rotatable about an axis of the eccentric portion 34 and shaped to have a truncated conical outer surface with the diameter thereof gradually increasing from the front end toward the rear end, a cutter assembly 48 fixedly attached to the front end portion of the rotor 44, an external gear 60 fixedly attached to the partition wall 20, and an internal gear 62 fixedly attached to the rotor 44 so as to be eccentric from the external gear 60 by a distance indicated by e and meshing with the external gear 60.

Further, the shield tunnelling machine 72 may be also provided with a discharge mechanism 68 as shown by a two-dotted line in FIG. 5.

While excavation is done, both the drive mechanism 36 and the jacks 78 are operated to thereby advance the tunnelling machine 72. Further, since the crankshaft 30 is rotated about the axis of the shield body 74, both of the rotor 44 and the cutter assembly 48 are revolved about the axis of the shield body 74 while being rotated about the axis of the eccentric portion 34.

As a result, the working face is excavated by the cutter assembly 48 and the excavated substances are received in the chamber 80. While the rotor 44 revolves and rotates, large solid bodies contained in the excavated substances received in the chamber 80 are crushed by the rotor 44 in cooperation with the shield body 74. The excavated substances in the chamber 80 are forcibly thrust out of the periphery of the shield body 74 through each of the window holes 26 with the revolution of the rotor 44. The substances 64 thrust out around the shield body 16 are discharged between the existing earth and sand 66 and the shield body 74 by compressing the existing earth and sand 66 around the shield body 74, as shown in FIG. 5.

The substances 64 and earth and sand 66 around the shield body 74 are repeatedly compressed by the revolution of the rotor 44. Accordingly, the substances 64 and earth and sand 66 around,, the shield body 74 are gradually consolidated while the expansive force of the substances 64 and that of the earth and sand 66 are gradually reduced. As a result, a great quantity of earth and sand may be discharged to the periphery of the shield body 74 and there is no possibility of increasing the resistance between the shield body 74 and the earth and sand therearound when the tunnelling machine 72 is advanced.

A hole excavated by the shield tunnelling machine 72 may be maintained by incorporating a new segment ring 76 therein.

Figure 6:
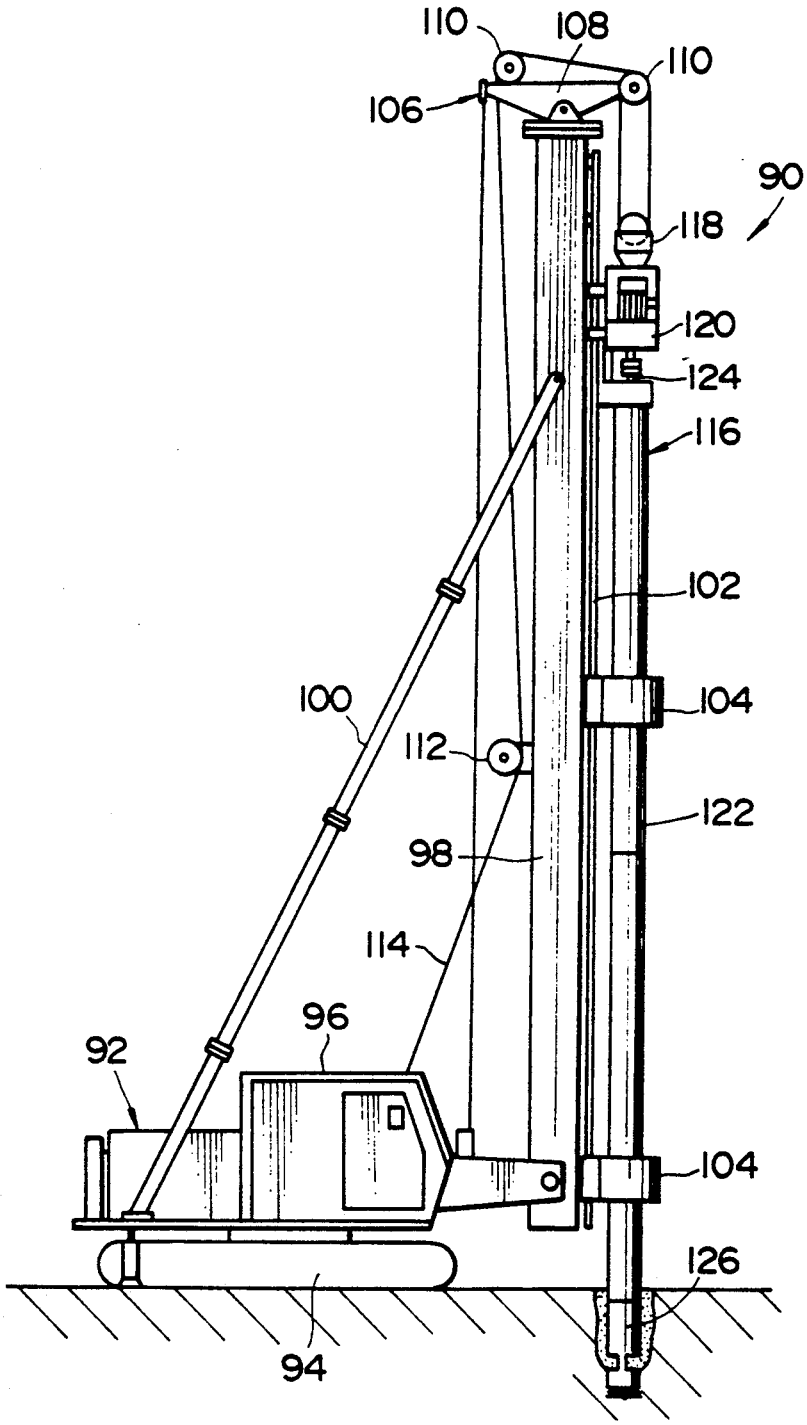
FIG. 6 is a front view showing a further embodiment of the boring apparatus according to the present invention.

A boring apparatus 90 as shown in FIG. 6 is used for forming a longitudinal hole, similar to an earth auger. The boring apparatus 90 comprises a tractor 92. The tractor 92 is a well known tractor which includes a lower structure 94 using a caterpillar and an upper structure 96 revolvingly supported by the lower structure 94. The upper structure 96 is provided with an operating section.

The front end portion of the upper structure 96 supports a strut 98 oriented as to extend in the vertical direction by an arm 100 extending from the upper structure 96. To the strut 98 is attached a rod 102 oriented in the vertical direction and annular guides 104 are attached to the rod 102. The guides 104 are spaced apart from each other in the vertical direction.

The upper end portion of the strut 98 supports a sheave mechanism 106 such that the mechanism 106 is angularly rotatable about the axis extending in the horizontal direction. The sheave mechanism 106 is provided with a seesaw 108 pivotally attached to the upper portion of the strut 98 and a sheave 110 rotatably and independently disposed on opposite ends of the seesaw 108.

Around each of the sheaves 110 is wound a wire rope 114 extending from a winch (not shown) disposed on the upper structure 96 through a roller 112 rotatably attached approximately midway along the longitudinal length of the strut 98 so as to return to the upper structure 96. An excavating machine 116 is suspended by the wire rope 114.

The excavating machine 116 includes a pulley 118 suspended by the wire rope 114. To the pulley 118 is attached a drive mechanism 120 provided with a motor and a reduction gear. The drive mechanism 120 is guided by the rod 102 so as to permit the vertical movement of the drive mechanism. To the drive mechanism 120 is connected a pipe assembly 122, which extends downward from the drive mechanism and consists of a plurality of pipes connected to each other in series, so as to be movable in the vertical direction together with the drive mechanism 120. The pipe assembly 122 slidably extends through each of the guides 104.

To an output shaft of the drive mechanism 120 is connected a rotary shaft 124 rotatably extending through the pipe assembly 122. An excavating mechanism 126 is connected to the lower end portion of the pipe assembly 122.

Figure 7:
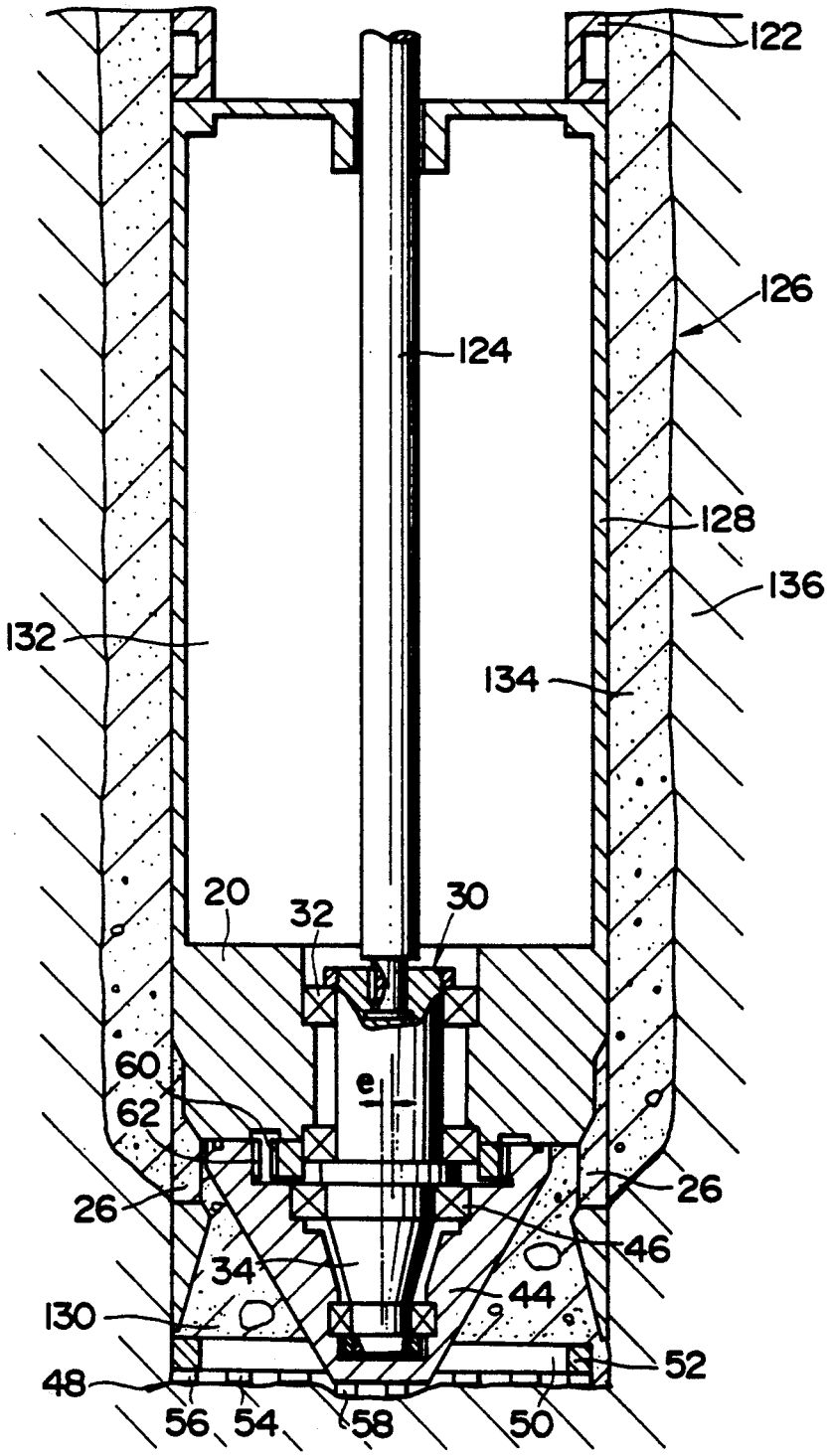
FIG. 7 is an enlarged-scale longitudinal cross-sectional view showing a portion of an excavating machine for the use in the boring apparatus of FIG. 6.

As shown in FIG. 7, the excavating mechanism 126 includes a cylindrical body 128 extending in the vertical direction. The upper end portion of the body 128 is connected to the lower end portion of the pipe assembly 122. The body 128 has a partition wall 20 for dividing the interior of the body 128 into two chambers 130, 132 spaced apart from each other in the axial direction of the body and a plurality of window holes 26 for communicating between the chamber 130 and the outside of the body 128. The chamber 130 has a truncated conical shape with the bore gradually tapering toward the rear.

The excavating mechanism 126 includes a crankshaft 30 supported by the partition wall 20 through a plurality of bearings 32 such that the crankshaft 30 is rotatable about an axis of the body 128, a rotor 44 supported by an eccentric portion 34 of the crankshaft 30 such that the rotor 44 is rotatable about an axis of the eccentric portion 34 and shaped to have a truncated conical outer surface with the diameter thereof gradually increasing from the front end toward the rear end, a cutter assembly 48 fixedly attached to the front end portion of the rotor 44, an external gear 60 fixedly attached to the partition wall 20, and an internal gear 62 fixedly attached to the rotor 44 so as to be eccentric from the external gear 60 by a distance indicated by e and meshing with the external gear 60. The excavating machine 116 may be also provided with a discharge mechanism 68 as shown by a two-dotted line in FIG. 1.

Each of the members as noted above is similar in structure and arrangement to the corresponding one of the members as shown in FIGS. 1 through 5. Accordingly, the crankshaft 30 is so arranged that the eccentric portion 34 of the crankshaft is located inside the chamber 130. However, the crankshaft 30 in this embodiment is connected to the rotary shaft 124.

While boring is done, the excavating machine 116 pays out the rope 114 by a predetermined amount at a time, whereby the excavating machine 116 is made to descend by its own weight. When the excavating machine 116 is descended, the drive mechanism 120 is operated. By so doing, the crankshaft 30 is rotated about the axis of the body 128, so that both of the rotor 44 and the cutter assembly 48 are revolved about the axis of the body 128 while being rotated about the axis of the eccentric portion 34.

As a result, the bottom of a hole is excavated by the cutter assembly 48 and the excavated substances are received in the chamber 130. While the rotor 44 revolves around the axis of the body 128 and rotates around its own axis, large solid bodies contained in the excavated substances received in the chamber 130 are crushed by the rotor 44 in cooperation with the body 128. The excavated substances in the chamber 130 are forcibly thrust out of the periphery of the body 128 through each of the window holes 26 with the revolution of the rotor 44. The substances 134 thrust out of the shield body 128 are discharged between the body 128 and the existing earth and sand 136 by compressing the existing earth and sand 136 around the body 128, as shown in FIG. 7.

The substances 134 and earth and sand 136 around the body 128 are repeatedly compressed with the revolution of the rotor 44. Accordingly, the substances 134 and earth and sand 136 are gradually consolidated while the expansive force of the substances 134 and that of the earth and sand 136 are gradually reduced. As a result, a great quantity of earth and sand may be discharged to the periphery of the body 128 and there is no possibility of increasing the resistance between the body 128 and the earth and sand therearound when the excavating mechanism 126 is advanced.

When the boring is done to a predetermined depth, the excavating machine 116 is pulled out by winching up the rope 114 with the winch and then a pile is inserted into a spot produced after the excavation. The pile is stably maintained by the earth and sand around the pile with the lapse of time.

What is claimed is:

1. A method for boring a hole in the ground comprising the steps of:

advancing an excavating machine having a tubular body and excavating means disposed in the front portion of the body while excavating the ground by use of said excavating means;

receiving excavated substances in a chamber behind said excavating means and formed in said body;

subjecting a rotor disposed in the chamber to an eccentrical movement to radially propel the excavated substances; and thrusting substantially all of said excavated substances propelled by the rotor out of said body substantially uniformly around the periphery of said body through at least one excavated substance exit hole formed in said body laterally of said rotor and providing communication between the chamber and the outer periphery of said body.

2. A method according to claim 1, wherein said rotor is subjected to eccentrical movement when the rotor is revolved about the longitudinal axis of said body while rotated about an axis parallel to the longitudinal axis of said body, and solids contained in said excavated substances in said chamber are compressed against said body by said rotor to crush said solids.

3. An apparatus for boring a hole in the ground, said apparatus comprising:

a tubular body;

excavating means disposed at the front portion of said body to excavate said ground;

a partition wall disposed inside said body to define together, with said body, a chamber for receiving substances excavated by said excavating means;

thrusting means including a rotor disposed inside said chamber and movable eccentrically relative to said body, for thrusting out the excavated substances received in said chamber to the periphery of said body;

a drive mechanism connected to said excavating means and to said thrusting means to drive said excavating means and said thrusting means; and at least one excavated substance exit hole formed in said body laterally of said rotor and providing communication between the chamber and the outer periphery of said body through which substantially all of said excavated substances are thrust out substantially uniformly around the periphery of said body by the eccentric movement of said rotor.

4. An apparatus according to claim 3, wherein said rotor has a configuration of a truncated cone whose diameter gradually increases from the front end toward the rear end of said cone.

5. An apparatus according to claim 4, wherein said chamber of said body has a configuration whose inner diametral dimension gradually decreases from the front end toward the rear end of said chamber.

6. An apparatus according to claim 3, wherein said drive mechanism includes a crankshaft rotatably supported by said partition wall and provided with a eccentric portion; and a drive source, said rotor being supported by said eccentric portion.

7. An apparatus according to claim 6, wherein said drive mechanism further includes an external gear attached to one of said rotor and said partition wall; and an internal gear attached to the other of said rotor and said partition wall to mesh with said external gear, said rotor being rotatably supported by said eccentric portion.

8. An apparatus for boring a hole in the ground, said apparatus comprising:

a tubular body;

excavating means disposed at the front portion of said body to excavate said ground;

a partition wall disposed inside said body to define together, with said body, a chamber from receiving substances excavated by said excavating means;

thrusting means including a rotor disposed inside said chamber and movable eccentrically relative to said body, for thrusting out the excavated substances received in said chamber to the periphery of said body;

a drive mechanism connected to said excavating means and to said thrusting means to drive said excavating means and said thrusting means; and a plurality of excavated substance exit holes formed in said body laterally of said rotor and providing communication between the chamber and the outer periphery of said body through which substantially all of said excavated substances are thrust out substantially uniformly around the periphery of said body by the eccentric movement of said rotor.

9. An apparatus according to claim 8, wherein said rotor has a configuration of a truncated cone whose diameter gradually increases from the front end toward the rear end of said cone.

10. An apparatus according to claim 9, wherein said chamber of said body has a configuration whose inner diametral dimension gradually decreases from the front end toward the rear end of said chamber.

11. An apparatus according to claim 8, wherein said drive mechanism includes a crankshaft rotatably supported by said partition wall and provided with an eccentric portion, and a drive source, said rotor being supported by said eccentric portion.

12. An apparatus according to claim 11, wherein said drive mechanism further includes an external gear attached to one of said rotor and said partition wall and an internal gear attached to the other of said rotor and said partition wall to mesh with said external gear, said rotor being rotatably supported by said eccentric portion.

* * * * *

UNITED STATES PATENT AND TRADEMARK OFFICE

CERTIFICATE OF CORRECTION

PATENT NO. : 5,078,545

DATED : January 7, 1992

INVENTOR(S) : Toshio Akesaka

It is certified that error appears in the above-identified patent and that said Letters Patent is hereby corrected as shown below:

Column 1, line 6 change "367/541" to --367,541--.

Column 3, line 31 after "a", insert --line--.

Column 3, line 50 change "exerting" to --exerts--.

Column 4, line 37 change "thereon" to --thereof--.

Column 5, line 54 after "force" insert --of--.

Column 5, line 55 after "quantity" insert --of-- and after "periphery" insert --of--.

Column 5, line 58 change "the", second occurrence, to --therearound--.

Column 5, line 59 after "advanced" insert --.--

Column 5, line 61 after "setting" insert --a distance-- and after "the", second occurrence, insert --ground--.

Column 5, line 63 after "force" insert --equilibrates--.

Column 5, line 66 change "no" to --not only--.

Column 5, line 67 after "In" insert --the--.

Column 5, line 68 after "ground", first occurrence, insert --such-- and after "the" insert --excavated--.

UNITED STATES PATENT AND TRADEMARK OFFICE

CERTIFICATE OF CORRECTION

PATENT NO. : 5,078,545

DATED : January 7, 1992

INVENTOR(S) : Toshio Akesaka

It is certified that error appears in the above-identified patent and that said Letters Patent is hereby corrected as shown below:

Column 6, line 1 change "subs" to --substances--.

Column 6, line 2 after "provided" insert --instead--.

Column 6, line 4 change "s" to --shield--.

Column 6, line 5 after "the", first occurence, insert --surface--.

Column 6, line 6 after "machine" insert --12--.

Column 6, line 7 after "less" insert --liable--.

Column 6, line 8 after "according" insert --to the--.

Column 7, line 37 delete --,,--.

Signed and Sealed this

Fourteenth Day of June, 1994

Bruce Lehman

*Attest:*

BRUCE LEHMAN

*Attesting Officer*

*Commissioner of Patents and Trademarks*